United States Patent [19]

Kishino et al.

[11] 4,049,993

[45] Sept. 20, 1977

[54] MULTI-DIGIT FLUORESCENT DISPLAY TUBE WITH INCLINED FILAMENT CATHODE

[75] Inventors: Takao Kishino; Yukihiko Utamura, both of Mobara, Japan

[73] Assignee: Futaba Denshi Kogyo K. K., Japan

[21] Appl. No.: 689,902

[22] Filed: May 25, 1976

[30] Foreign Application Priority Data

May 31, 1975 Japan ..... 50-64835

[51] Int. Cl.[2] ..... H01J 19/08; H01J 19/42; H01J 63/06

[52] U.S. Cl. ..... 313/497; 313/302; 313/343; 313/294

[58] Field of Search ..... 313/496, 497, 495, 294, 313/302, 343, 214

[56] References Cited

U.S. PATENT DOCUMENTS

| | | | |
|---|---|---|---|
| 2,048,232 | 7/1936 | Snow | 313/294 |
| 2,887,610 | 5/1959 | Smith | 313/495 X |
| 3,136,911 | 6/1964 | Crawford et al. | 313/496 |
| 3,958,150 | 5/1976 | Kobayakawa et al. | 313/497 X |

*Primary Examiner*—Palmer C. Demeo

*Attorney, Agent, or Firm*—Oblon, Fisher, Spivak, McClelland & Maier

[57] ABSTRACT

A multi-digit fluorescent display tube comprising a multi-digit pattern display member including display units for respective digits disposed in parallel and composed of segment anodes, each segment anode having a phosphor layer, and at least one cathode stretched along the longitudinal direction of the pattern display member to confront the respective multi-digit pattern display units in common, wherein the cathode is disposed in an inclined manner and the perveance in each display unit is adjusted, so that when the cathode is heated and actuated by a direct current power source, the display brightness is substantially uniform in the display units for respective digits.

5 Claims, 8 Drawing Figures

MULTI-DIGIT FLUORESCENT DISPLAY TUBE WITH INCLINED FILAMENT CATHODE

Figure 1A:
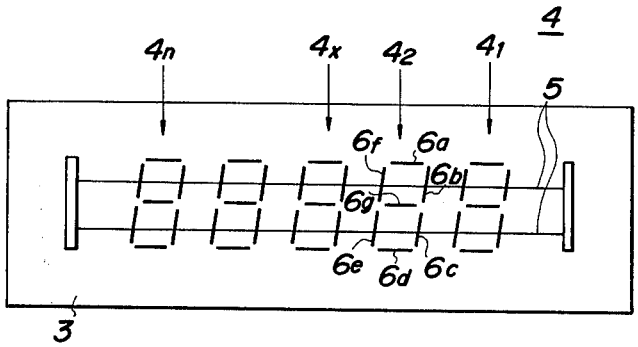

This invention relates to a multi-digit fluorescent display tube (hereinafter referred to as "fluoroescent display tube"). More particularly, the invention relates to a fluorescent display tube of the type suitable for application in the state where a cathode is heated by a direct current (hereinafter referred to as "direct current put-on type"), which is suitable for a small electronic table calculator (hereinafter referred to as "table calculator") and a digital display electronic clock (hereinafter referred to as "digital clock").

In general, a fluorescent display tube includes a phosphor emitting fluorescence under irradiation with electrons from a cathode, and since a very legible display is obtained by this tube, it is broadly used for digital display in various electronic instruments such as a table calculator and a digital clock. A fluorescent display tube of this type is a thermionic tube of a composite diode or triode structure including a so-called filamentary direct current-heating cathode (hereinafter referred to as "filament") and a plurality of anodes. These anodes are segment anodes, each comprising a phosphor layer displaying a specific figure, letter or symbol selectively among a plurality of figures, letters or symbols ("letters" will hereinafter be mentioned as representatives of these display marks) and constituting one of multi-digital pattern display units. One filament common to all of these multi-digit display units is stretched to confront the respective display units. Accordingly, a potential distribution, namely the difference of the potential based on the voltage of an operating circuit, is brought about between the common filament and the respective segment anodes constituting the pattern display units, and this potential distribution varies depending on the value of the voltage applied to the filament. Therefore, when the filament is heated and actuated by a direct current power source, the brightness of the fluorescent display tube differs among the pattern display units. Especially in case of a multi-digit display tube having a long filament to which a high heating voltage is applied, the brightness of the fluorescent display is changed in order in the respective display units.

A driving circuit of the so-called dynamic drive type (hereinafter referred to as "dynamic driving circuit") is often used for a table calculator including a fluorescent display tube. When this dynamic driving circuit is used, it is sufficient to dispose one decoder even for multi-digit display units, and this decoder can form input signals to the segment anodes of the respective display units so as to display optional letters selectively. Accordingly, the circuit structure is simplified, and the number of external terminals of LSI and the fluorescent display tube is reduced. By virtue of these characters, this dynamic driving circuit is broadly used for table calculators having a large digit number.

When this dynamic driving circuit is used for an instrument using a direct current power source such as a cell, for example, a handy type table calculator, in general, a converter is employed to form a feed direct current voltage (generally higher than the cell voltage) for applying a pulse voltage to anodes and control electrodes through LSI or the like. Further, in order to obtain a uniform display brightness in each of multi-digit display units, an alternating current voltage is formed as the power source of the filament by a transformer used in this convertor, and the circuit is arranged so that the filament is heated by this alternating current voltage. Further, even when the direct current voltage necessary for anodes and control electrodes is so low that provision of a convertor is unnecessary, there is a problem that in order to obtain a uniform display brightness in each of multi-digital display units, it is necessary to especially dispose an inverter for forming an alternating current voltage as the power source for the filament from the direct current of the cell.

In case of the above-mentioned dynamic driving circuit, pulse currents causing noises run in the circuit and the fluorescent display tube during the operation, and therefore, this dynamic driving circuit cannot be applied to a display instrument to be built in a noise-disliking electronic device, such as a digital clock to be built in a radio.

As the driving circuit not using pulse currents, there is known a driving circuit of the static drive type (hereinafter referred to as "static driving circuit"), which is often used for digital clocks. Since the voltage to be applied to this circuit is lower than that to be applied to the dynamic driving circuit, this static driving circuit is characterized in that a direct current of the power source for LSI can be commonly used for this circuit. Further, when this circuit is used for an electronic instrument to be equipped in a car, there is attained an advantage that a direct current of a battery can directly be used without using a convertor or the like.

However, for the reason set forth above with respect to the dynamic driving circuit, if it is intended to heat the filament of the fluorescent display tube by a direct current power source in this static driving circuit, it is impossible to obtain a uniform display brightness in each of the respective multi-digit display units. Accordingly, even when this static driving circuit is employed, in order to obtain a uniform display brightness in each of multi-digit display units, it is necessary to dispose an inverter or the like for forming an alternating current voltage for heating the filament from a direct current power source such as a battery or cell. This is a problem encountered when the static driving circuit is used for a multi-digit fluorescent display tube.

It is therefore a primary object of the present invention to provide a novel fluorescent display tube of the direct current put-on type in which all of the problems involved in the conventional techniques can be solved.

Other objects and advantages of the present invention will be apparent from the following detailed description.

In accordance with one principal aspect of the present invention, there is provided a multi-digit fluorescent display tube comprising a multi-digit pattern display member including display units for respective digits disposed in parallel and composed of segment anodes, each segment anode having a phosphor layer, and at least one filament as a cathode stretched along the longitudinal direction of the pattern display member to confront the respective multi-digit pattern display units in common, wherein the filament is disposed in an inclined manner and the preveance in each display unit is adjusted, so that when the filament is heated and actuated by a direct current power source the display brightness is substantially uniform in the display units for respective digits.

Figure 1B:
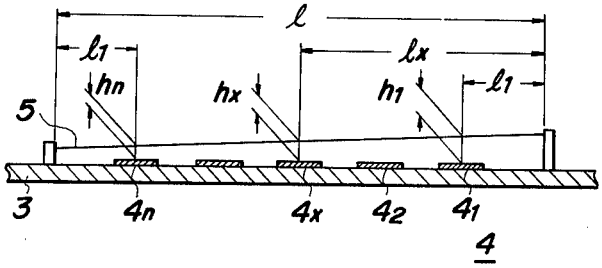
Figure 2:
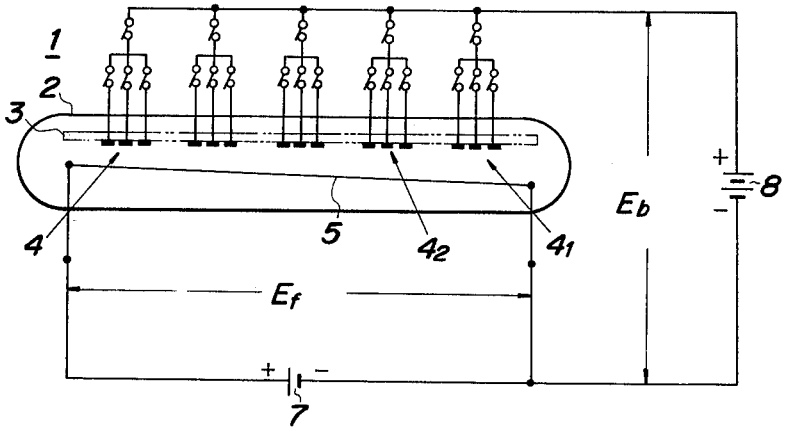
Figure 3A:
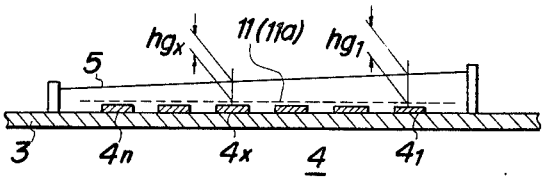
Figure 3B:
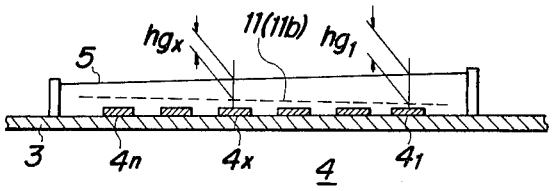
Figure 3C:
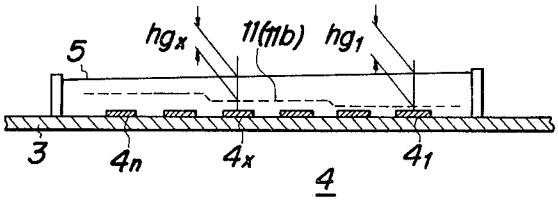
Figure 4A:
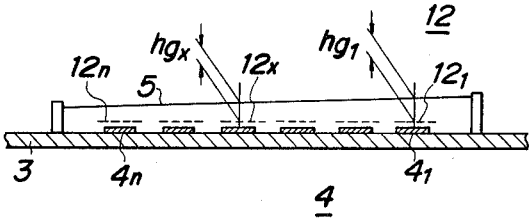
Figure 4B:
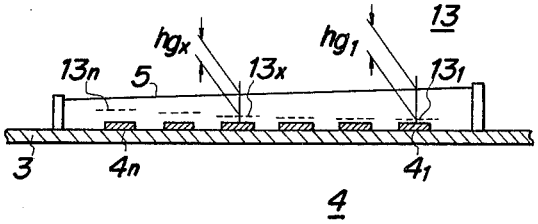

The present invention will now be described in detail by reference to the accompanying drawings, in which:

FIG. 1(A) and 1(B) are plan and sectional views illustrating the main part of one embodiment of the multi-digit fluorescent display tube according to the present invention;

FIG. 2 is a view illustrating the principle of a circuit to be applied to the multi-digit fluorescent display tube shown in FIGS. 1(A) and 1(B);

FIG. 3(A), FIG. 3(B) and FIG. 3(C) are sectional views illustrating the main parts of other embodiments of the multi-digit fluorescent display tube according to the present invention; and FIG. 4(A) and 4(B) are sectional views illustrating the main parts of still other embodiments of the multi-digit fluorescent display tube according to the present invention.

FIGS. 1(A), 1(B) and 2 are plan and sectional views illustrating the main part of the first embodiment in which the present invention is applied to a fluorescent display tube of the diode structure and a view illustrating the principle of a circuit applied to this fluorescent display tube.

In the drawings, a fluorescent display tube 1 having in an external housing 2 a multi-anode diode structure including a multi-digit pattern display member 4 (including display units $4_1 \ldots 4_n$ for respective digits) disposed on the top face of a substrate 3 and a filament 5 stretched along the longitudinal direction of the multi-digit pattern display member 4 to confront the display units $4_1$ to $4_n$ in common. Each of the display units $4_1$ to $4_n$ of the multi-digit display member 4 has such a structure that a plurality of letters can be displayed selectively by a plurality of segment electrodes 6 (6*a* . . . 6*g*), and each segment anode 6 has on the surface thereof a layer of a phosphor capable of emitting a fluorescence under irradiation with electrons from the filament. A direct current power source 7 is disposed to apply a direct current voltage E*f* to the filament 5 to thereby heat the filament 5, and another direct current power source 8 is disposed to apply a direct current anode voltage E*b* between the filament 5 and the segment anodes 6 of the selected display unit of the multi-digit pattern display member 4.

In the fluorescent display tube having the above-mentioned principal diode structure, the relation between the brightness L of each display unit of the multi-digit pattern display member 4 and the anode voltage E*b* is represented by the following formula:

$$L = GAEb^{2.5} \tag{1}$$

wherein $G$ denotes the perveance which is determined by the formula $G = B/h^2$ in which $h$ is a distance between the filament and the anode and $B$ is a constant determined by the geometrical dimension of the anode, and $A$ is a constant determined by such factors as the fluorescence efficiency of the phosphor and the anode area.

In the multi-anode structure, as shown in FIG. 1, including a plurality of display units $4_1$ to $4_n$ for respective digits disposed in parallel to confront the common filament 5 stretched along the longitudinal direction of the multi-digit display member 4, an approximate value of the anode voltage E*bx* at the pattern display unit $4_x$, namely the unit at the $x$-th digit from the right, is expressed as follows:

-continued $$Ebx \approx Eb - \frac{Ef \cdot l_x}{l} \tag{2}$$

wherein $e$ is a length between both the ends of the filament, and $e_x$ is a length of the filament between the right end and the point confronting the pattern display unit $4_x$.

When the polarity of the direct current power source 7 for the filament 5 is made reverse to that shown in the drawings, an approximate value of the anode voltage E*bx*′ is expressed as follows:

$$Ebx' \approx Eb + \frac{Ef \cdot l_x}{l} \tag{2'}$$

As will be apparent from the foregoing, when the filament 5 is heated by a direct current, values of anode voltages E*b* (E$b_1$ to E$b_n$) applied to the respective pattern display units $4_1$ to $4_n$ disposed in parallel differ from one another. Supposed that the height of the filament 5 at the point confronting the pattern display unit $4_x$ of an optional $x$-th digit spaced from the right end of the filament by a length $l_x$ is expressed as $h_x$, the following relation between the brightness $L_x$ at the pattern display unit $4_x$ and the above filament height $h_x$ can be derived from the above formula (1):

$$h_x = C \cdot L_x^{-\frac{1}{2}} \left(Eb - \frac{Ef \cdot l_x}{l}\right)^{\frac{5}{4}} \tag{3}$$

wherein $C$ is a constant determined by such factors as the fluorescence efficiency of the phosphor, the anode area, the distance between the cathode and the anode and the geometrical dimensions of the electrodes.

From the above formula (3), it is seen that in order to obtain a uniform brightness L in all of the display units for respective digits of the multi-digit pattern display member 4, it is necessary and sufficient to stretch the filament 5 at a height $h_x$ determined by the position $l_x$ of each pattern display unit $4_x$ of the multi-digit pattern display member 4.

More specifically, in the fluorescent display tube 1 of the present invention, in order to make the brightness L substantially uniform in all of the display units $4_1$ to $4_n$ for respective digits of the pattern display member 4, in view of the relation shown by the above formula (3), the filament 5 is stretched in an inclined manner so that the height of the filament 5 at the position confronting a pattern display unit $4_x$ of an optional $x$-th digit spaced from the right end of the filament 5 by a distance $l_x$ is always $h_x$ calculated from the formula (3).

In practice, in the fluorescent display tube of the present invention, it is preferred that the heights of the filament 5 for the respective display units $4_1$ to $4_n$ be within a range of about ± 10% of values $h_x$ calculated from the above formula (3). If the heights of the filament 5 are arranged within this range, the deviation of the brightness L among the respective display units can be controlled to about 20% or less, if the deviation caused by other conditions excluded. Accordingly, in the present invention, there is obtained an effect that the brightness is visually substantially uniform in the respective display units.

A practical method for stretching the filament 5 in such an inclined manner that the brightness L is substantially uniform in the respective display units in the fluorescent display tube of the present invention will now be described.

For example, the heights $h_1$ and $h_n$ of the filament 5 at positions confronting both the terminal pattern display units $4_1$ and $4_n$ are calculated from the formula (3), and the filament 5 is linearly stretched to pass through the points $h_1$ and $h_n$. If the filament 5 is stretched in this manner, the heights of the filament 5 at positions confronting intermediate display units of the pattern display member 4 are made to approximate to the calculated values, and the deviation of the brightness L can be much reduced in the display units for the intermediate digits as well as in both the terminal display units. In the case where the number of digits is large and a considerably long filament 5 is stretched, one or more intermediate holding pieces (not shown) are disposed so that the heights of the filament 5 at intermediate positions can be fixed to the calculated values $h_x$ by these holding pieces. Especially good results are obtained when these holding pieces are arranged so that they can also act as so-called dampers for protecting the filament 5 from shaking, shock and vibration.

The fluorescent display tube of the present invention will now be described more specifically by using specific numerical values with respect to an embodiment in which the display member 4 has display units for 5 digits.

Referring now to FIGS. 1 and 2, when the length $l$ of the filament 5, the length $l_1$ from both the terminal ends of the filament to both the terminal digit positions, Eb and Ef are fixed to 80 mm, 12 mm, 20 V and 3 V, respectively and when the height $h_1$ of the filament 5 at the point confronting the pattern display unit $4_1$ fr the first digit on the right end is set to 2.3 mm, if the height $h_5$ of the filament 5 at the point confronting the pattern display unit $4_5$ for the 5th digit on the left end is made equal to the height $h_1$, the brightness $L_5$ of the pattern display unit $4_5$ for the 5th digit, as calculated according to the formula (1), is darker by about 33.4% than the brightness $L_1$ of the pattern display unit $4_1$ for the first digit.

In order to make the brightness $L_5$ of the 5th digit display unit on the left end equal to the brightness $L_1$ of the first digit display unit on the right end, the height $h_5$ of the filament 5 at the point confronting the display unit $4_5$ on the left end must be arranged so as to satisfy the requirement of the formula (3). This height $h_5$ is calculated as 2.0 mm from the formula (3).

When both the heights $h_1$ and $h_5$ are set to 2.3 mm and 2.0 mm, respectively and when the filament 5 is stretched to pass through these points $h_1$ and $h_5$ so as to make the brightness $L_5$ at the pattern display unit $4_5$ equal to the brightness $L_1$ at the pattern display unit $4_1$, an error of the height $h_3$ of the filament 5 at the central point confronting the central display unit $4_3$ for the third digit is within 1% based on the value $h_3$ calculated from the formula (3). Accordingly, no visual difference of the brightness is brought about among the display units for the respective digits.

FIGS. 3(A), 3(B) and 3(C) illustrate second, third and fourth embodiments of the fluorescent display tube according to the present invention, and each FIG. shows the main part corresponding to the main part of the tube shown in FIG. 1(B) and members and elements having the same functions as in FIG. 1 are denoted by the same reference numerals as used in FIG. 1.

Each of the embodiments shown in these FIGS. 3(A), 3(B) and 3(C) is in agreement with the first embodiment shown in FIG. 1 with respect to the principal structure of the present invention in which a pattern display member 4 including a plurality of display units $4_1$ to $4_n$ for respective digits arranged in parallel is disposed on the top face of a substrate 3 and a common filament 5 is disposed along the longitudinal direction of the pattern display member 4 in a manner inclined with respect to the pattern display units $4_1$ to $4_n$. In each of the embodiments shown in FIGS. 3(A), 3(B) and 3(C), a control electrode 11 electrically connected integrally with all the digits is disposed between the filament 5 and the display units $4_1$ to $4_n$ of the pattern display member 4. In the embodiment shown in FIG. 3(A), the control electrode 11*a* is disposed substantially in parallel to the pattern display units $4_1$ to $4_n$ and in the embodiment shown in FIG. 3(B), the control electrode 11*b* is disposed in an inclined manner as the filament 5. In the embodiment shown in FIG. 3(C), the control electrode 11*c* is disposed stepwise so that each step portion of the control electrode 11*c* covers one or more digits and the respective steps differ in succession from one another with respect to the distance from the corresponding display unit.

Each of these control electrodes 11 (11*a*, 11*b* and 11*c*) is electrically connected integrally with all the display units for the respective digits, and if during the operation a potential the same as or almost similar to the positive potential applied to the segment anode of the pattern display unit is applied to such control electrode 11, electrons emitted from the filament 5 toward the segment anodes constituting each display unit of the pattern display member 4 are accelerated and disturbance of the electric field by charging of electrons around the segment anodes on the top face of the substrate 3 is prevented. In the triode structure including such control electrode 11 (11*a*, 11*b* or 11*c*), as the factor for making uniform the brightness L in all of the display units $4_1$ to $4_n$, there is adopted a height $hg$ ($hg_x$) of the filament 5 to the control electrode 11 (11*a*, 11*b* or 11*c*) at the point confronting the pattern display unit $4_x$ instead of the height $h$ ($h_x$) of the filament 5 to the pattern display unit $4_x$ calculated from the formula (3) in the above-mentioned diode structure shown in FIG. 1. Accordingly, in the embodiments shown in FIG. 3(B) and 3(C), if the inclination of the control electrode 11*b* to the pattern display units $4_1$ to $4_n$ or the distance of the control electrode 11*c* from the pattern display units $4_1$ to $4_n$ is appropriately adjusted, the deviation of the brightness caused in the central portion by stretching the filament linearly in the above-mentioned manner can be appropriately moderated or expelled. Accordingly, there is attained an effect that when the filament 5 is put on by a direct current, the uniformity of the brightness L among the respective digit pattern display units $4_1$ to $4_n$ can be further improved.

In each of the foregoing embodiments shown in FIGS. 3(A), 3(B) and 3(C), in the control electrode 11 (11*a*, 11*b* or 11*c*) disposed between a plurality of the pattern display units $4_1$ to $4_n$ of the pattern display member 4 and a common filament 5 disposed in a manner inclined with respect to the pattern display member 4, it is of course possible to adjust the brightness by changing the porosity of the control electrode 11 among parts confronting the respective digit display units. If the deviation of the brightness caused in the central portion by linearly stretching the filament in the inclined manner is appropriately reduced by this arrangement, there is attained an effect that the uniformity of the brightness L among the respective digits of the pattern display member 4 can be further enhanced.

FIGS. 4(A) and 4(B) illustrate fifth and sixth embodiments of the fluorescent display tube according to the present invention. Each of these FIGS. 4(A) and 4(B) shows the main part corresponding to the main part of the tube shown in FIG. 1(B), and in each of FIGS. 4(A) and 4(B), members and elements having the same functions as in FIG. 1 are denoted by the same reference numerals.

Each of the embodiments shown in FIGS. 4(A) and 4(B) is in agreement with the first embodiment shown in FIG. 1 with respect to the principal structure of the present invention in which a pattern display member 4 including a plurality of display units $4_1$ to $4_n$ for respective digits arranged in parallel is disposed on the top face of a substrate 3 and a common filament 5 is disposed in a manner inclined with respect to the pattern display units $4_1$ to $4_n$. In the embodiments shown in FIGS. 4(A) and 4(B), control electrodes $12_1$ to $12_n$ or $13_1$ to $13_n$ corresponding to the pattern display units $4_1$ to $4_n$ for respective digits of the pattern display member 4 are disposed between the respective display units $4_1$ to $4_n$ and the common filament 5. In the embodiment shown in FIG. 4(A), each of these control electrodes $12_1$ to $12_n$ is equidistantly spaced from the corresponding display unit but in the embodiment shown in FIG. 4(B), the control electrodes 13 are disposed stepwise so that each of the control electrodes $13_1$ to $13_n$ covers one or more digits of the pattern display units $4_1$ to $4_n$ and the respective steps of the control electrodes differ in succession from one another with respect to the distance from the corresponding display unit.

These control electrodes $12_1$ to $12_n$ or $13_1$ to $13_n$ are disposed to correspond to the respective digit display units $4_1$ to $4_n$ of the pattern display member 4, respectively. In the embodiments shown in FIGS. 4(A) and 4(B), when the filament 5 is heated by a direct current power source and a potential same as or almost similar to a positive potential applied to the segment anode is applied to a control electrode $12_x$ or $13_x$ of an optionally selected digital, and when an anode voltage Eb is simultaneously applied between the segment anode and the filament 5, desirable letters or the like of the optionally selected digit can be displayed, and in this case, there is attained an effect that the brightness of the fluorescent display can be made substantially uniform among all the digits. In the triode structure including control electrodes $12_1$ to $12_n$ or $13_1$ to $13_n$, as the factor making uniform the brightness L in all of the display units $4_1$ to $4_n$ of the pattern display member 4, there is adopted a height $hg$ ($hg_x$) of the filament 5 to the control electrode $12_x$ or $13_x$ corresponding to the pattern display unit $4_x$ instead of the height $h$ ($h_x$) of the filament 5 to the pattern display unit $4_x$ calculated from the formula (3) in the above-mentioned diode structure shown in FIG. 1. Accordingly, in the embodiment shown in FIG. 4(B), if the distances between the control electrodes $13_1$ to $13_n$ and the corresponding pattern display units $4_1$ to $4_n$ are appropriately adjusted, the deviation of the brightness L caused in the central portion by stretching the filament 5 linearly in the above-mentioned manner can be appropriately moderated or expelled. Accordingly, there is attained an effect that when the filament 5 is put on by a direct current, the uniformity of the brightness L among the respective digit pattern display units $4_1$ to $4_n$ can be further enhanced.

In each of the foregoing embodiments shown in FIGS. 4(A) and 4(B), it is of course possible to adjust the brightness by changing the porosity of the control electrodes $12_1$ to $12_n$ or $13_1$ to $13_n$ disposed on the respective digit display units $4_1$ to $4_n$, respectively, appropriately with respect to every display unit. If the deviation of the brightness caused in the central portion by linearly stretching the filament 5 in the inclined manner is appropriately reduced by this arrangement, there is attained an effect that the uniformity of the brightness L among the respective digits of the pattern display member can be further enhanced.

As will be apparent from the foregoing illustration, in the fluorescent display tube of the present invention, by disposing the filament in a manner inclined with respect to the pattern display member of a plurality of digits, there can be attained an excellent effect that when the filament is heated and actuated by a direct current, fluorescent displays substantially uniform in the brightness can be obtained in all of pattern display units for respective digits of the pattern display member. By virtue of this excellent effect, the following advantages are attained in the fluorescent display tube of the present invention.

1. An inverter heretofore used for forming an alternating current source for heating a filament need not be inserted into a driving current for actuating the fluorescent display tube, and the filament can be directly heated by a direct current power source such as a battery or cell. Accordingly, there is attained an advantage that the driving circuit can be made smaller and simplified, and hence, the fluorescent display tube is very advantageous from the economical viewpoint. If there is adopted such structure that the anodes are actuated by the same voltage as that for driving the filament, for example, a voltage of a battery placed on an automobile, the fluorescent display tube of the present invention can be applied very easily and economically advantageously to a digital clock for a car in which very legible digital displays can be obtained with a single battery power source and a very simple driving circuit.

2. Further, as pointed out hereinbefore, the fluorescent display tube of the present invention has such structure that it can be actuated with a single direct current power source and a static driving circuit not causing noises, and therefore, it can be applied very conveniently with great ease and economical advantages to a digital clock to be built in a radio or the like, in which very legible degital displays can easily be obtained.

3. In the fluorescent display tube of the present invention having control electrodes disposed for respective digit display units, a plurality of display units for respective degits can be driven by a dynamic driving circuit and a mechanism for forming an alternating current for heating the filament need not particularly be disposed in the dynamic driving circuit. Accordingly, the fluorescent display tube of the present invention can be applied conveniently with economical advantages to a small table calculator of the multidigit system including a dynamic driving circuit which is advantageous from the economical viewpoint and can easily be made smaller.

Thus, it will readily be understood that the present invention makes great contributions to the art.

What is claimed is:

1. A multi-digit fluorescent display tube comprising:

a planar insulating substrate;

a plurality of digit fluorescent displays arranged in a row in spaced side-by-side relationship along the longitudinal width of the planar substrate to form a plurality of planar digit fluorescent displays;

each digit fluorescent display comprising a plurality of segment anodes disposed to selectively form one of a plurality of digits and deposited phosphor layers thereon;

at least one filament cathode stretched along the longitudinal width of the planar insulating substrate adjacent to the plurality of digit fluorescent displays but separated therefrom;

the filament cathode being disposed at an acute angle with respect to the planar insulating substrate so that distances between the filament cathode and each of the plurality of digit fluorescent displays are linearly progressively shorter so that the perveance of each of the plurality of digit fluorescent displays is adjusted so as to illuminate each of the plurality of digit fluorescent displays in uniform brightness when the fluorescent display tube is operated by heating the filament cathode with a direct current power source; and a light transparent evacuated sealed envelope in which the plurality of digit fluorescent displays and the filament cathode are disposed and through which the plurality of digit fluorescent displays may be viewed externally when the fluorescent display tube is in operation.

2. A multi-digit fluorescent display tube in accordance with claim 1 further comprising a control electrode disposed between the filament cathode and each of the plurality of digit fluorescent displays.

3. A multi-digit fluorescent display tube in accordance with claim 1 further comprising a plurality of control electrodes, one for each of the plurality of digit fluorescent displays, each control electrode being disposed between its digit fluorescent display and the filament cathode.

4. A multi-digit fluorescent display tube in accordance with claim 1 wherein the filament cathode is disposed with respect to each of the plurality of digit fluorescent displays at distances *hx* wherein $$h_x = C \cdot LX^{-\frac{1}{2}} \left(Eb - \frac{Ef \cdot l_x}{l}\right)^{\frac{5}{4}}$$

wherein *C* is a constant determined by the fluorescent efficiency of the phosphor, the anode area, the distance between the filament cathode and the segment anode, and geometrical dimensions of the electrodes; *LX* is the brightness of any one of selected digit fluorescent displays; *Eb* is an anode voltage of any one of selected digit fluorescent displays; *l* is a length between both ends of the filament cathode; *Ef* is a filament voltage; and *lx* is a length of the filament cathode between one end of the filament cathode and a point confronting any one of selected digit fluorescent displays when the digit fluorescent display disposed closet to the other end of the filament cathode is disposed closest to the filament cathode and the digit fluorescent display disposed closest to the one end of the filament cathode is disposed farthest from the filament cathode.

5. A multi-digit fluorescent display tube in accordance with claim 4 wherein the filament cathode is disposed with respect to each of the plurality of digit fluorescent displays at distances within a range of ± 10% of the values of *hx*.

* * * * *